US006334797B1

(12) United States Patent
Liang

(10) Patent No.: US 6,334,797 B1
(45) Date of Patent: Jan. 1, 2002

(54) BATTERY TERMINAL CONNECTOR

(76) Inventor: Shih-Tsung Liang, No. 10, Lane 31, Ta-Feng St., Neitsou Tsun, Lu-Chu Hsiang, Taoyuan County (TW)

( * ) Notice: Subject to any disclaimer, the term of this patent is extended or adjusted under 35 U.S.C. 154(b) by 0 days.

(21) Appl. No.: 09/652,675

(22) Filed: Aug. 31, 2000

(51) Int. Cl.[7] ..... H01R 4/42
(52) U.S. Cl. ..... 439/763; 439/764
(58) Field of Search ..... 439/761–764

(56) References Cited

U.S. PATENT DOCUMENTS 5,171,169 A * 12/1992 Butcher et al. ..... 439/763
5,599,210 A * 2/1997 Green ..... 439/763

* cited by examiner

*Primary Examiner*—Gary F. Paumen
*Assistant Examiner*—James Harvey
(74) *Attorney, Agent, or Firm*—Rosenberg, Klein & Lee

(57) ABSTRACT

A battery terminal connector is constructed having a mounting part and a wire distribution part integral with the mounting part, the mounting part having two clamping arms adapted for securing to a terminal of a battery by a screw bolt, the wire distribution part having a forwardly extended opening and two wire distribution portions formed integral with the clamping arms and separated by the forwardly extended opening for receiving a respective electric wire.

4 Claims, 3 Drawing Sheets

BATTERY TERMINAL CONNECTOR

BACKGROUND OF THE INVENTION

The present invention relates to a battery terminal connector adapted to connect electric wires to a terminal of a battery, and more particularly to a simple structure of battery terminal, which is inexpensive to manufacture and, can positively be secured to the terminal of the battery.

FIGS. 5 and 6 show a battery terminal connector according to the prior art. This structure of battery terminal connector comprises a wire distribution part 3 adapted to receive electric wires 4, and two clamping arms 31 adapted for fastening to a battery terminal 21. The wire distribution part 3 has a plurality of screw holes at the top for the mounting of screws 41 to secure respective electric wires 4. The clamping arms 31 each have an arched rear portion respectively extended from the wire distribution part 3, and a free end terminating in an extension portion 32. The arched rear portions of the clamping arms 31 define split mounting hole 311 adapted to receive the battery terminal 21. After attaching the split mounting hole 311 to the battery terminal 21, a screw bolt 33 is fastened to the extension portions 32 of the clamping arms 31 to secure the clamping arms 31 to the battery terminal 21. This structure of battery terminal connector has drawbacks. Because the arched rear portions of the clamping arms 31 are connected to each other and formed integral with the solid wire distribution part 3, the clamping arms 31 have less resilient power, and a gap may be left between the clamping arms 31 and the battery terminal 21 after installation of the battery terminal connector. Because the clamping arms 31 have less resilient power, much effort should be employed when fastening the clamping arms 31 to the battery terminal 21. During installation, it is complicated to fasten up the screw bolt 33. If the screw bolt 33 is not tightly fastened up, the battery terminal connector may be forced out of position. Further, when fastening up the screw bolt 33 with force, the threads of the screw bolt 33 may be damaged.

SUMMARY OF THE INVENTION

It is one object of the present invention to provide a battery terminal connector, which can easily be installed with less effort. It is another object of the present invention to provide a battery terminal connector, which can positively be secured to the battery terminal to achieve satisfactory electric conducting effect. To achieve these and other objects of the present invention, there is provided a battery terminal connector, which comprises a mounting part and a wire distribution part integral with the mounting part. The mounting part comprises two clamping arms adapted for securing to a terminal of a battery by a screw bolt. The wire distribution part comprises a forwardly extended opening, and two wire distribution portions formed integral with the clamping arms and separated by and displaceable into the forwardly extended opening for receiving a respective electric wire. The forwardly extended opening greatly increases the resilient power of the clamping arms, enabling the clamping arms to be turned inwards and outwards within a wide range for easy installation without causing damage.

DETAILED DESCRIPTION OF THE PREFERRED EMBODIMENT

Figure 1:
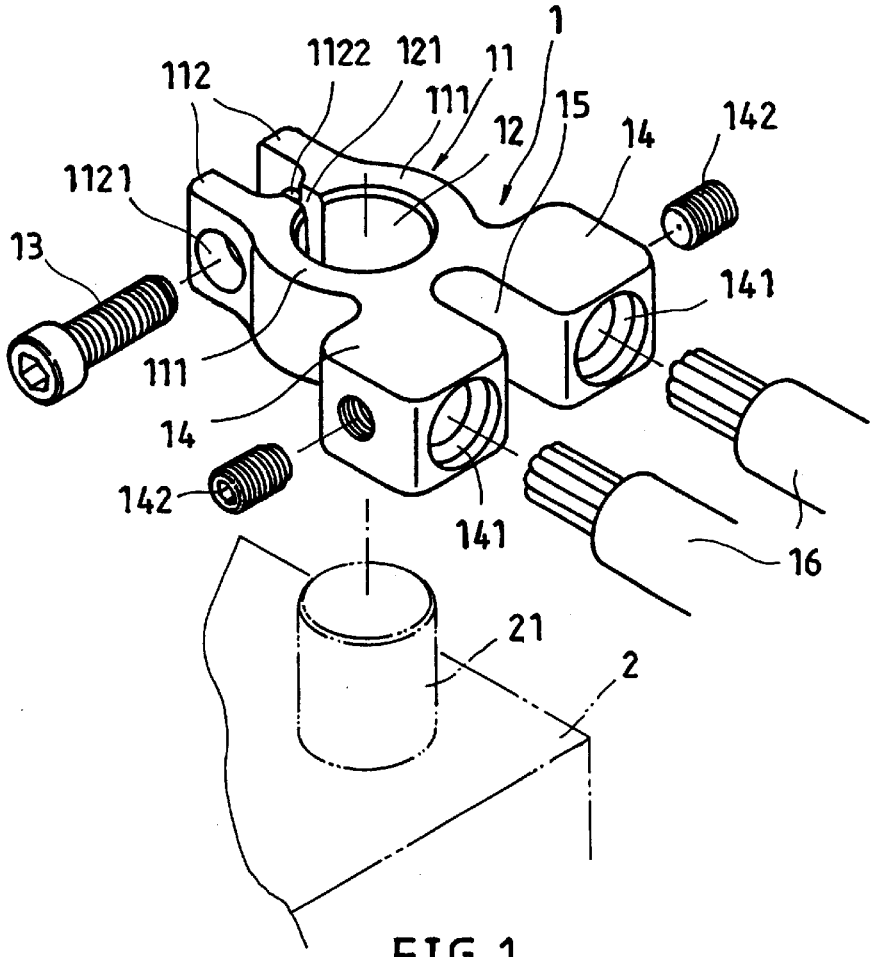
FIG. 1 illustrates a battery terminal connector according to one embodiment of the present invention.
Figure 2:
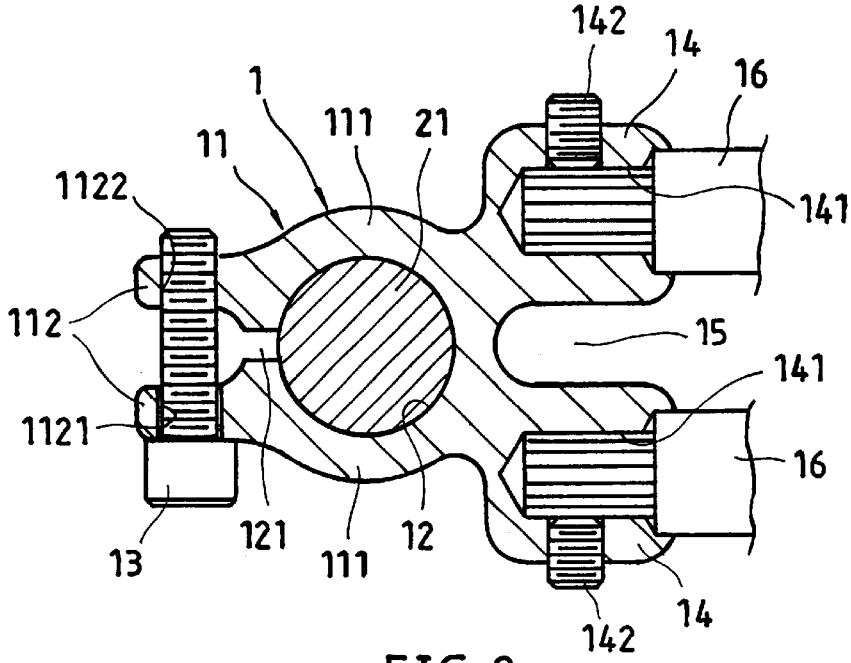
FIG. 2 is a sectional assembly view of FIG. 1.

Referring to FIGS. 1 and 2, a battery terminal connector 1 is shown comprising a metal mounting part 11, and a metal wire distribution part integral with the mounting part 11. The mounting part 11 comprises two clamping arms 111 arranged in parallel. The clamping arms 111 define a circular mounting hole 12 and a narrow gap 121 in communication with the circular mounting hole 12, each having a front extension portion 112. A through hole 1121 is made through the front extension portion 112 of one clamping arm 111, and a screw hole 1122 is made through the front extension portion 112 of the other clamping arm 111. When in use, the circular mounting hole 12 is coupled to the terminal 21 of the battery 2, and then a screw bolt 13 is inserted into the through hole 1121 and threaded into the screw hole 112 to secure the clamping arms 111 firmly to the terminal 21 of the battery 2. The aforesaid wire distribution unit comprises a forwardly extended opening 15, which divides the wire distribution unit into two wire distribution portions 14. The wire distribution portions 14 each comprise a front wire hole 141, which receives a respective electric wire 16. A tightening up screw 142 is threaded into a respective screw hole on each wire distribution portion 14 to secure the respective electric wire 16 to the respective wire hole 141, keeping the conductors of the respective electric wire 16 in close contact with the inside wall of the respective wire distribution portion 14. As indicated, the two wire distribution portions 14 are formed integral with the clamping arms 111 of the mounting part 11 and separated by and displaceable into the opening 15. This design enables the clamping arms 111 to be turned outwards and inwards relative to each other without causing damage.

Figure 3:
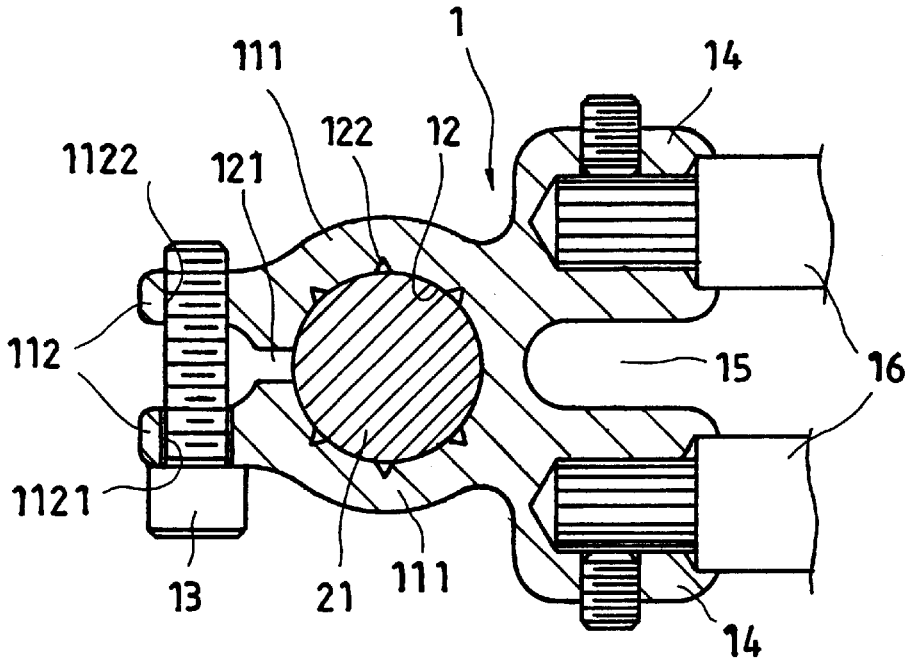
FIG. 3 is a sectional view of an alternate form of the present invention.

FIG. 3 shows an alternate form of the present invention. According to this alternate form, notches 122 are formed on the clamping arms 111 around the circular mounting hole 12 for enabling the clamping arms 111 to be positively secured to the terminal 2 of the battery 2 (see also FIG. 1).

Figure 4:
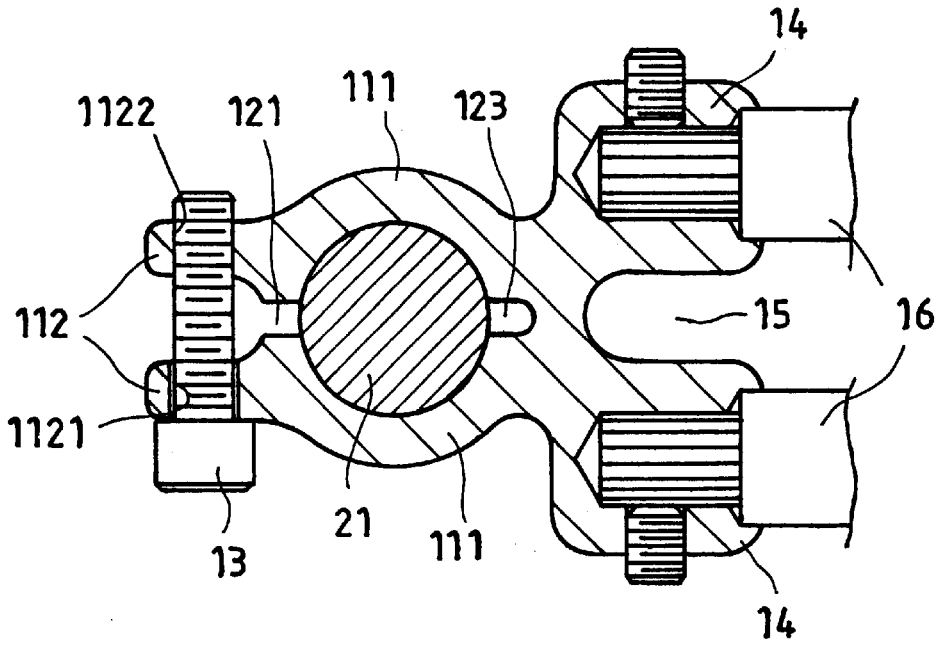
FIG. 4 is a sectional view of another alternate form of the present invention.
Figure 5:
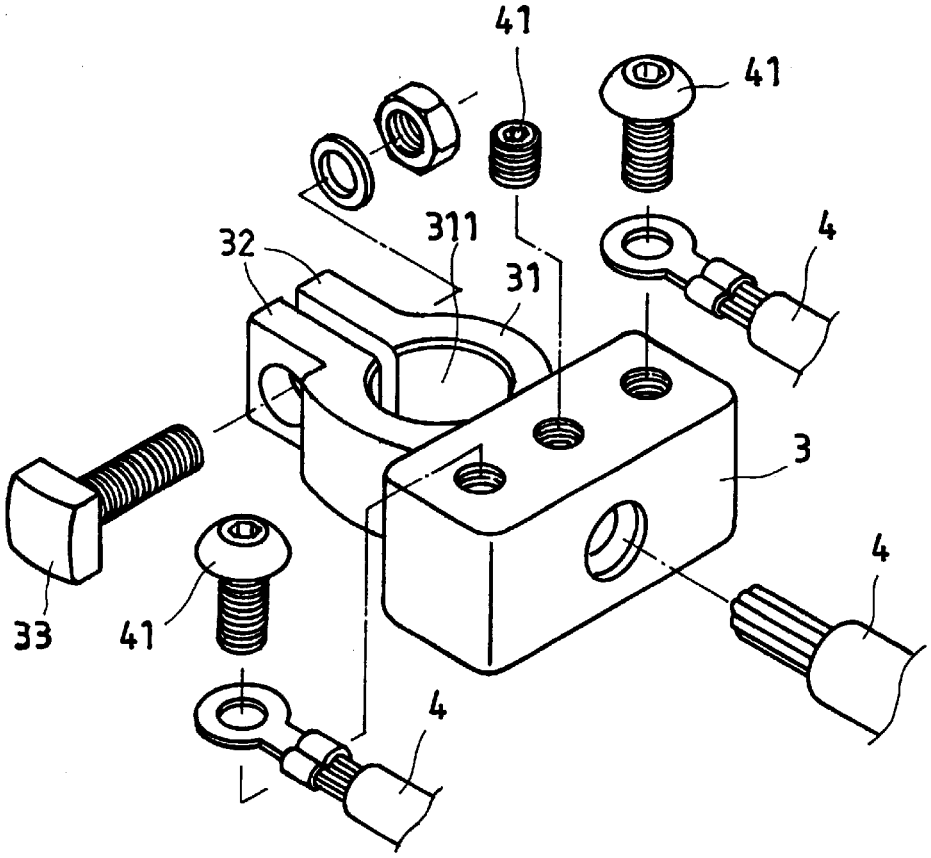
FIG.5 PRIOR ART
FIG. 5 illustrates a battery terminal connector according to the prior art.
Figure 6:
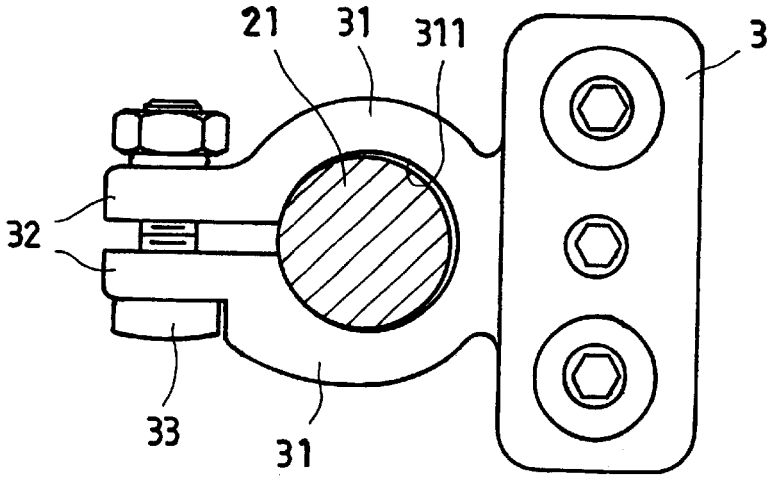
FIG.6 PRIOR ART
FIG. 6 is a sectional view showing the prior art battery terminal connector installed.

FIG. 4 shows another alternate form of the present invention. According to this alternate form, a notch 123 is formed in the mounting part 11 backwardly extended from the circular mounting hole 21 toward the opening 15 of the wire distribution part and opposite to the narrow gap 121. The notch 123 enables the clamping arms 111 to be opened wider without causing damage.

It is to be understood that the drawings are designed for purposes of illustration only, and are not intended for use as a definition of the limits and scope of the invention disclosed.

What the invention claimed is:

1. A battery terminal connector comprising a metal mounting part adapted for fastening to a terminal of a battery, and a metal wire distribution part formed integrally with said mounting part and adapted to receive electric wires, said mounting part comprising a first clamping arm and a second clamping arm arranged in parallel, said first clamping arm and said second clamping arm each having a front extension portion, a circular mounting hole defined between said first clamping arm and said second clamping arm and adapted to receive the terminal of the battery, a narrow gap extending from said circular mounting hole and separating said first clamping arm from said second clamping arm for enabling said first clamping arm and said second clamping arm to be attached to the terminal of the battery at two sides, a through hole formed through the front extension portion of said first clamping arm, a screw hole formed through the front extension portion of said second clamping arms and a screw bolt adapted for mounting in the through hole on the front extension portion of said first clamping arm and threading into the screw bole on the front extension portion of said second clamping arm to secure said first clamping arm and said second clamping arm to the terminal of the battery, said wire distribution part comprising a (forwardly) extending opening, and a plurality of wire distribution portions respectively formed integrally with said first clamping arm and said second clamping arm of said mounting part and separated by and displaceable into said forwardly extended opening and adapted to receive a respective electric wire.

2. The battery terminal connector of claim 1 wherein said mounting part comprises a plurality of notches formed on said first clamping arm and said second clamping arm and spaced around said circular mounting hole.

3. The battery terminal connector of claim 1 wherein said mounting part comprises a notch extending rearwardly from said circular mounting hole toward said wire distribution part and opposite to said narrow gap.

4. The battery terminal connector of claim 1 wherein said wire distribution portions of said wire distribution part each comprise a front wire hole adapted to receive an electric wire, and a tightening up screw adapted to secure an electric wire in the respective front wire hole.

* * * * *